US008757961B1

(12) United States Patent
Liang

(10) Patent No.: US 8,757,961 B1
(45) Date of Patent: Jun. 24, 2014

(54) INDUSTRIAL TURBINE STATOR VANE

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 557 days.

(21) Appl. No.: 13/113,038

(22) Filed: May 21, 2011

(51) Int. Cl.
*F01D 5/18* (2006.01)

(52) U.S. Cl.
USPC ..... 415/115; 416/97 R

(58) Field of Classification Search
CPC ..... F01D 9/02; F01D 9/06; F01D 9/065; F02D 2230/21; F02D 2240/127
USPC ..... 415/115, 116; 416/90 R, 96 R, 97 R
See application file for complete search history.

(56) References Cited

U.S. PATENT DOCUMENTS

| | | | | |
|---|---|---|---|---|
| 5,498,126 | A * | 3/1996 | Pighetti et al. | 415/115 |
| 5,511,309 | A * | 4/1996 | Beabout | 29/889.72 |
| 5,669,759 | A * | 9/1997 | Beabout | 416/97 R |
| 6,132,169 | A * | 10/2000 | Manning et al. | 415/115 |
| 6,884,036 | B2 * | 4/2005 | Shi et al. | 416/97 R |
| 7,118,325 | B2 * | 10/2006 | Kvasnak et al. | 415/115 |
| 7,150,601 | B2 * | 12/2006 | Pietraszkiewicz et al. | 416/97 R |
| 7,704,046 | B1 * | 4/2010 | Liang | 416/96 R |
| 7,704,048 | B2 * | 4/2010 | Liang | 416/97 R |
| 7,785,072 | B1 * | 8/2010 | Liang | 416/97 R |
| 7,967,567 | B2 * | 6/2011 | Liang | 416/97 R |
| 8,221,055 | B1 * | 7/2012 | Liang | 415/115 |
| 8,328,518 | B2 * | 12/2012 | Liang et al. | 416/96 R |
| 8,459,934 | B2 * | 6/2013 | Hofmann et al. | 415/115 |
| 8,511,968 | B2 * | 8/2013 | Liang et al. | 415/115 |
| 2007/0297916 | A1 * | 12/2007 | Levine et al. | 416/96 R |
| 2009/0068023 | A1 * | 3/2009 | Liang | 416/97 R |
| 2010/0054915 | A1 * | 3/2010 | Devore et al. | 415/116 |
| 2011/0038735 | A1 * | 2/2011 | Liang et al. | 416/97 R |
| 2011/0103932 | A1 * | 5/2011 | Dueckershoff et al. | 415/115 |
| 2012/0148383 | A1 * | 6/2012 | Gear et al. | 415/115 |

FOREIGN PATENT DOCUMENTS

WO WO 2009118245 A1 * 10/2009

* cited by examiner

*Primary Examiner* — Edward Look
*Assistant Examiner* — Christopher R Legendre
(74) *Attorney, Agent, or Firm* — John Ryznic

(57) ABSTRACT

An industrial turbine stator vane with a aft flowing serpentine flow cooling circuit with an inner endwall turn channel having a rib extending into the first leg of the serpentine circuit, where the rib separates the turn channel from a purge air channel located along the lower end of the leading edge wall that opens into a front rim cavity to discharge purge air. The separate purge air channel minimizes pressure loss in the serpentine flow and maintains high flow velocity to cool the lower end of the leading edge wall.

9 Claims, 5 Drawing Sheets

INDUSTRIAL TURBINE STATOR VANE

GOVERNMENT LICENSE RIGHTS

None.

CROSS-REFERENCE TO RELATED APPLICATIONS

None.

BACKGROUND OF THE INVENTION

1. Field of the Invention

The present invention relates generally to a gas turbine engine, and more specifically to a turbine stator vane in a large industrial engine with purge air for a rim cavity.

2. Description of the Related Art Including Information Disclosed Under 37 CFR 1.97 and 1.98

In a gas turbine engine, such as a large frame heavy-duty industrial gas turbine (IGT) engine, a hot gas stream generated in a combustor is passed through a turbine to produce mechanical work. The turbine includes one or more rows or stages of stator vanes and rotor blades that react with the hot gas stream in a progressively decreasing temperature. The efficiency of the turbine—and therefore the engine—can be increased by passing a higher temperature gas stream into the turbine. However, the turbine inlet temperature is limited to the material properties of the turbine, especially the first stage vanes and blades, and an amount of cooling capability for these first stage airfoils.

The first stage rotor blade and stator vanes are exposed to the highest gas stream temperatures, with the temperature gradually decreasing as the gas stream passes through the turbine stages. The first and second stage airfoils (blades and vanes) must be cooled by passing cooling air through internal cooling passages and discharging the cooling air through film cooling holes to provide a blanket layer of cooling air to protect the hot metal surface from the hot gas stream.

The turbine includes stages or rows of stator vanes and rotor blades with labyrinth seals formed between a rotating part and a static part to prevent hot gas ingestion from the main hot gas stream into an inter-stage housing. The rotor disks are much more temperature sensitive than the blades and vanes, and an over-temperature of the rotor disk can lead to premature cracking and thus rotor disk destruction. Thus, the need for purge air into the forward and aft rim cavities to prevent excess hot gas ingestion.

FIG. 1 shows a side view of a prior art turbine stator vane with an airfoil extending between an outer diameter endwall and an inner diameter endwall. FIG. 2 shows a top view of the serpentine flow cooling circuit of the prior art vane and includes a first leg or channel 11 along the leading edge of the airfoil, a second leg 12 and then a third leg 13 all connected in series. The third leg feeds cooling air to a row of exit holes 15 located along the trailing edge of the airfoil. Trip strips are used along the side walls of the legs to enhance heat transfer from the hot metal to the cooling air.

FIG. 3 shows a flow diagram for the prior art vane cooling circuit with the first leg 11 flowing into an inner endwall turn channel, then into the second leg and into an upper endwall turn channel, and then into the third leg and out through the exit holes 15 or the aft rim cavity purge hole 17 at the end of the third leg 13. A front rim cavity purge hole 16 is connected to the inner endwall turn channel to supply purge air to a front rim cavity.

FIGS. 5 and 6 shows prior art arrangements for purge air holes used for the front rim cavity. In both of these designs, a pressure loss in the cooling air occurs because of the path the cooling air travels for the serpentine flow circuit and for the purge air. The FIG. 5 design produces not only a large pressure drop but forms a stagnation zone along the lower end of the leading edge that results in low cooling air flow at this surface and causes a hot metal spot that leads to erosion. The FIG. 6 design produces a lower pressure loss than the FIG. 5 design, but also produces a pressure loss in the purge air flowing through the purge air hole on the bottom of the turn channel.

BRIEF SUMMARY OF THE INVENTION

A turbine stator vane for an industrial gas turbine engine, the vane having a serpentine aft flowing cooling circuit with a first leg located along a leading edge of the airfoil, curved turn channels between adjacent legs that are located outside of the endwalls so as to limit exposure to the hot gas stream, and a separate channel for rim cavity purge air formed by splitting up the cooling air flowing through the first leg in which some of the cooling air flows through a purge air hole located along the leading edge while the remaining cooling air flows into the inner endwall turn channel and through the remaining serpentine flow circuit. The cooling air at an end of the last leg then flows through a purge air hole into an aft rim cavity. The curved turn channels are smooth channels without trip strips to reduce pressure loss in the serpentine flow circuit.

DETAILED DESCRIPTION OF THE INVENTION

A turbine stator vane, especially for a large industrial engine, includes a serpentine aft flowing cooling circuit with smooth curved turn channels between adjacent legs of the serpentine flow circuit, and purge air holes located at an end of both the first leg and the third leg to provide purge air for the front rim cavity and the aft rim cavity.

Figure 1:
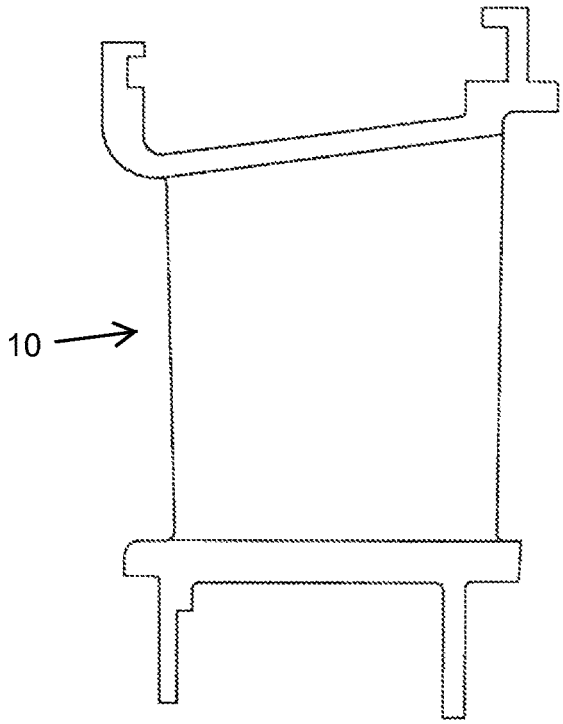
FIG 1 Prior Art
FIG. 1 shows a side view of a turbine stator vane of the prior art.
Figure 2:
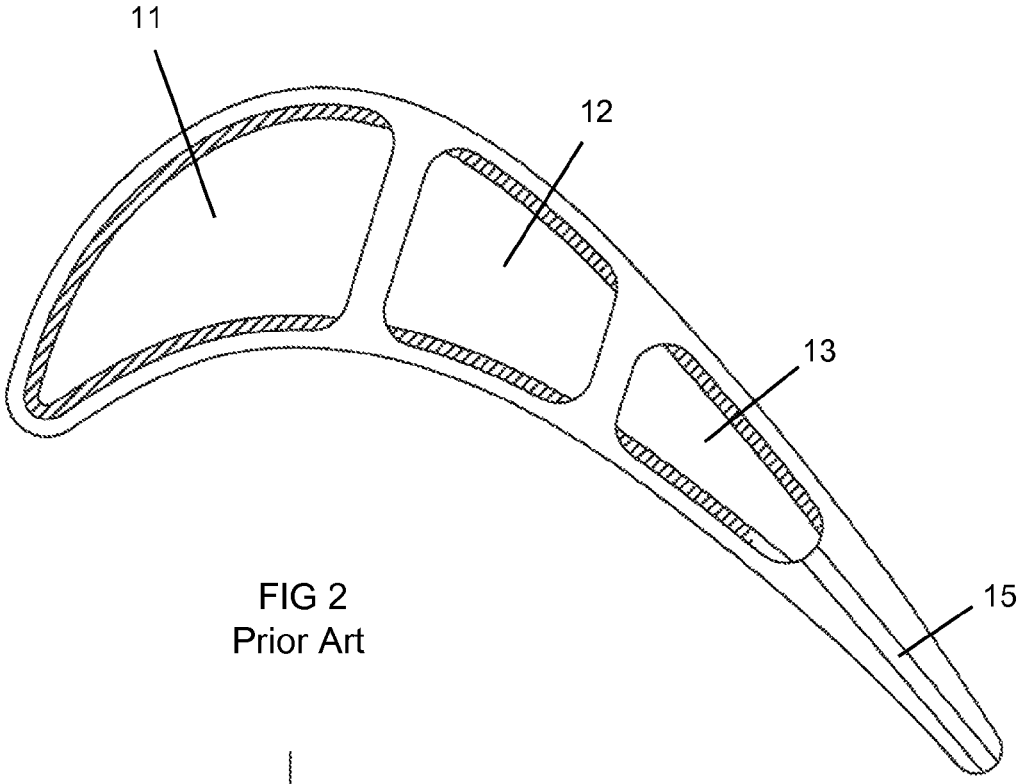
FIG 2 Prior Art
FIG. 2 shows a cross section top view of a serpentine flow cooling circuit used in the vane of the prior art.
Figure 3:
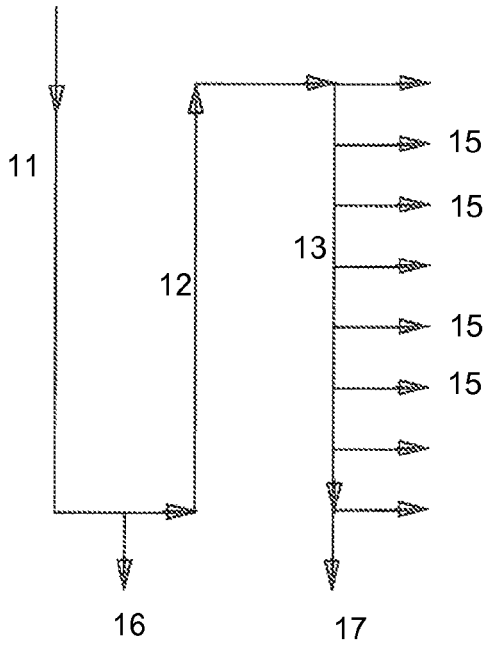
FIG 3 Prior Art
FIG. 3 shows a flow diagram for the cooling circuit of the vane in the prior art.
Figure 4:
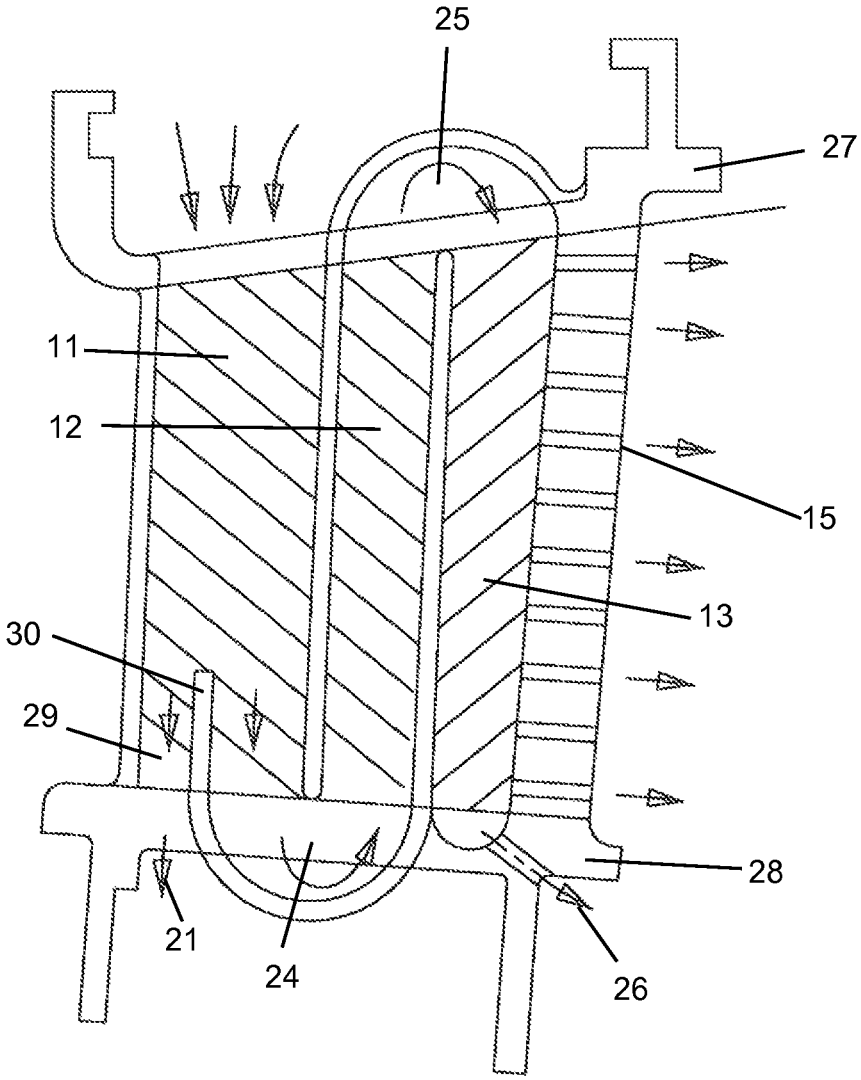
FIG. 4 shows a cross section side view for the cooling circuit of the vane in the present invention.
Figure 5:
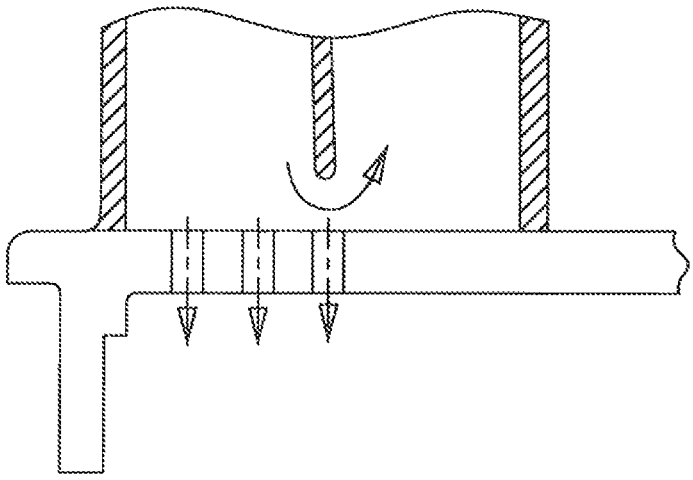
FIG 5 Prior Art
FIGS. 5 and 6 shows cross section side views of prior art vanes with purge air holes for the rim cavity.
Figure 6:
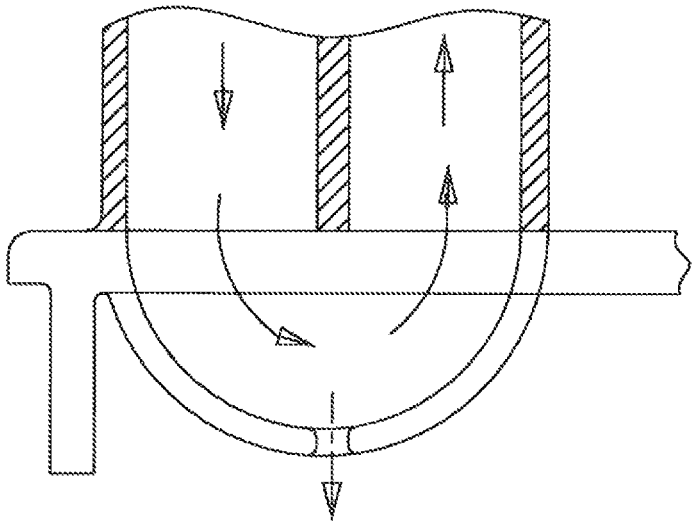
FIG 6 Prior Art
Figure 7:
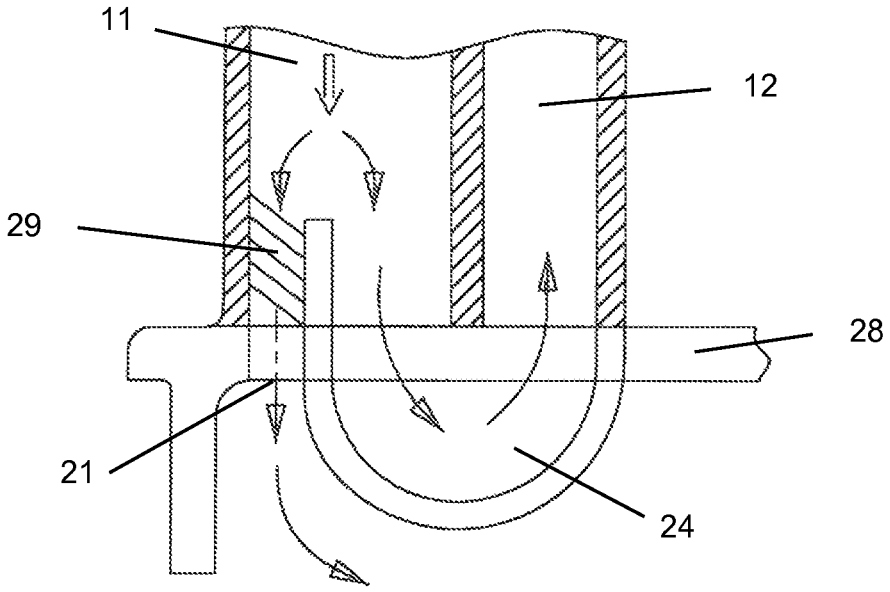
FIG. 7 shows a cross section side view of the purge air cooling hole for the rim cavity in the vane of the present invention.

FIG. 4 shows the vane cooling circuit of the present invention with an improved turn channel and front rim cavity purge air passage that increases the cooling air flow at the lower end of the leading edge wall to prevent the prior art hot spot from occurring, and to reduce the pressure loss in the serpentine flow cooling air through the turn channel. The vane includes the three-pass serpentine aft flowing cooling circuit with the first leg 11 and second leg 12 and third leg 13 with exit holes 15 along the trailing edge of the airfoil. An outer diameter turn channel 25 is used and extends out from the outer diameter endwall 27. An inner diameter endwall turn channel 24 connects the first leg 11 to the second leg 12 and extends outward from the inner diameter endwall 28. The third leg has a progressively decreasing cross sectional flow area because of the progressive bleed off of cooling air through the exit holes 15 in order to maintain a high flow velocity of the cooling air.

A front rim cavity purge channel 29 is formed at an end of the first leg between the leading edge wall and a rib that forms the turn channel 24. A rib 30 extends into the first leg 11 and separates the purge air channel 29 from the turn channel 24 within the first leg 11. This structure allows for the cooling air to maintain a high velocity so that adequate cooling of the leading edge wall will occur and a low pressure loss for the purge air 21 flowing into the front rim cavity.

The purge air hole 26 at an end of the third leg 13 will discharge the remaining cooling air from the third leg 13 into the aft rim cavity. Trip strips are used in the side walls of the three legs 11-13 in order to enhance a heat transfer coefficient. The two turn channels are without trip strips so that the smooth surfaces will limit pressure loss for the cooling air passing through the turns.

Major design features and advantages of the cooling circuit of the present invention are described below. The serpentine flow cooling circuit uses the rim cavity purge air for the airfoil cooling first and then flows into the rim cavity to provide cooling and purge air. This doubles the use of the cooling flow to improve the turbine stage performance. The leading edge of the vane airfoil is cooled with the entire cooling air flow and thus maximized the use of the cooling air for the airfoil cooling for the highest heat load region and minimizes the over-heating of cooling air delivery to the inter-stage housing. The purge air for the rim cavity is separated from the cooling air flow for the airfoil prior to the I.D. endwall turn channel in order to reduce the cooling air flow pressure loss and to minimize a change of the internal flow Mach number within the turn channel. Separating the purge air from the cooling air flow along the lower end of the leading edge surface of the airfoil provides for good cooling to this section of the leading edge of the airfoil where prior art hot spots are formed. The purge air hole at the end of the third leg can be used as additional support for the serpentine shaped ceramic core during casting of the vane.

I claim the following:

1. An industrial engine turbine stator vane comprising:

an airfoil extending between an outer diameter endwall and an inner diameter endwall;

a three-pass aft flowing serpentine cooling circuit formed within the airfoil with a first leg located along a leading edge of the airfoil and a third leg located adjacent to a trailing edge region of the airfoil;

a row of exit holes located along the trailing edge of the airfoil and connected to the third leg;

an outer diameter endwall turn channel connected between the second leg and the third leg;

an inner diameter endwall turn channel connected between the first leg and the second leg;

a rib extends into the first leg and separates a purge air channel from the inner diameter endwall turn channel;

the purge air channel opens into a front rim cavity; and, a purge air hole is connected to an end of the third leg and opens into an aft rim cavity.

2. The industrial engine turbine stator vane of claim 1, and further comprising:

the rib is parallel to the leading edge wall of the airfoil.

3. The industrial engine turbine stator vane of claim 1, and further comprising:

the two turn channels extend outward from the respective endwalls and form a smooth curved surface for the cooling air flow.

4. The industrial engine turbine stator vane of claim 1, and further comprising:

the three legs of the serpentine flow circuit have skewed trip strips along the side walls of the legs; and, the two turn channels are without trip strips and form a smooth surface for the cooling air flow to minimize pressure loss.

5. An air cooled stator vane for a gas turbine engine comprising:

an airfoil extending between an inner endwall and an outer endwall;

a multiple pass serpentine flow cooling circuit with a first leg located adjacent to a leading edge of the airfoil and a last leg located adjacent to a trailing edge region of the airfoil;

an inner diameter endwall turn channel connected between the first leg and a second leg of the multiple pass serpentine flow cooling circuit; and, the inner diameter endwall turn channel includes a rib that extends radially into the first leg and separates a purge air channel connected to a rim cavity from the inner diameter endwall turn channel connected to the second leg.

6. The air cooled turbine stator vane of claim 5, and further comprising:

the inner diameter endwall turn channel extends inward from the inner endwall and forms a smooth curved surface for the cooling air flow from the first leg to the second leg.

7. The air cooled turbine stator vane of claim 6, and further comprising:

the inner diameter endwall turn channel is without trip strips and forms a smooth surface for the cooling air flow to minimize pressure loss.

8. The air cooled turbine stator vane of claim 6, and further comprising:

the radial extending rib is parallel to a leading edge wall of the airfoil.

9. The air cooled turbine stator vane of claim 6, and further comprising:

a row of trailing edge exit holes connected to the last leg of the multiple pass serpentine flow cooling circuit; and, a second purge air hole connected to an end of the last leg and opening into an aft rim cavity.

* * * * *